US009658560B2

(12) United States Patent
Yokoi

(10) Patent No.: US 9,658,560 B2
(45) Date of Patent: May 23, 2017

(54) EXPOSING DEVICE AND IMAGE FORMING APPARATUS

(71) Applicant: BROTHER KOGYO KABUSHIKI KAISHA, Nagoya-shi, Aichi-ken (JP)

(72) Inventor: Junichi Yokoi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/725,572

(22) Filed: May 29, 2015

(65) Prior Publication Data

US 2015/0346628 A1 Dec. 3, 2015

(30) Foreign Application Priority Data

Jun. 3, 2014 (JP) ..... 2014-114876

(51) Int. Cl.
*B41J 2/47* (2006.01)
*G03G 15/043* (2006.01)
(Continued)

(52) U.S. Cl.
CPC ..... *G03G 15/043* (2013.01); *B41J 2/385* (2013.01); *G03G 15/04054* (2013.01)

(58) Field of Classification Search
USPC ..... 347/237, 23
See application file for complete search history.

(56) References Cited

U.S. PATENT DOCUMENTS 5,172,132 A * 12/1992 Haneda ..... H04N 1/40037 347/132
5,432,611 A * 7/1995 Haneda ..... H04N 1/58 347/119
(Continued)

FOREIGN PATENT DOCUMENTS

JP 2006-088588 A 4/2006
JP 2007-090758 A 4/2007
(Continued)

OTHER PUBLICATIONS

U.S. Appl. No. 14/864,414, filed Sep. 24, 2015.
(Continued)

*Primary Examiner* — Matthew Luu
*Assistant Examiner* — Lily Kemathe
(74) *Attorney, Agent, or Firm* — Merchant & Gould P.C.

(57) ABSTRACT

An exposing unit forms a scanning line by exposing an image surface in a main scanning direction, and forms a plurality of pixels arrayed in the main scanning direction by sequentially forming a plurality of scanning lines shifted in a sub-scanning direction. A clock generator generates frequency-spread clocks having frequency that is spread with a particular modulation period and that changes in accordance with a modulated waveform corresponding to the particular modulation period. A driver drives the exposing unit to emit light during light emitting time that is determined from the frequency-spread clocks. The plurality of scanning lines is formed with respective phases of the modulated waveform. The phases corresponding to the plurality of scanning lines are shifted from each other for compensating, among the plurality of scanning lines, deviations of the light emitting time relative to a reference value, for each of the plurality of pixels.

14 Claims, 9 Drawing Sheets

(51) Int. Cl.
*B41J 2/385* (2006.01)
*G03G 15/04* (2006.01)

(56) References Cited

U.S. PATENT DOCUMENTS

| | | | | |
|---|---|---|---|---|
| 6,825,457 | B2 * | 11/2004 | Sakamoto | G02B 26/123 250/236 |
| 2003/0025785 | A1 * | 2/2003 | Nihei | G06K 15/1219 347/250 |
| 2004/0100548 | A1 | 5/2004 | Seki | |
| 2008/0079025 | A1 * | 4/2008 | Inoue | B41J 2/45 257/205 |
| 2011/0012983 | A1 * | 1/2011 | Itabashi | B41J 2/473 347/232 |
| 2016/0091817 | A1 | 3/2016 | Yokoi | |

FOREIGN PATENT DOCUMENTS

| | | | |
|---|---|---|---|
| JP | 2007-125785 | A | 5/2007 |
| JP | 2014-49938 | A | 3/2014 |

OTHER PUBLICATIONS

U.S. Office Action (Notice of Allowance) issued in related U.S. Appl. No. 14/864,414 on Jun. 2, 2016.
U.S. Office Action issued in related U.S. Appl. No. 14/864,414 on Feb. 4, 2016.
Notice of Allowance from related U.S. Appl. No. 14/864,414, issued Jan. 25, 2017.

* cited by examiner

UPPER
LOWER
FRONT
REAR
ED
1
10
11
12
13
14
20
21
22
23
24
25
26
27
28
30
40
41
42
50
51
52
53
54
61
62
63
64
65
66
70
71
72
73
74
75
76
80
81
82
90
91
92
100
110
120
130
140
P

EXPOSING DEVICE AND IMAGE FORMING APPARATUS

CROSS REFERENCE TO RELATED APPLICATIONS

This application claims priority from Japanese Patent Application No. 2014-114876 filed Jun. 3, 2014. The entire content of the priority application is incorporated herein by reference.

TECHNICAL FIELD

An aspect of this disclosure relates to an exposing device and an image forming apparatus having the exposing device.

BACKGROUND

In exposure control of an exposing device, it is known that frequency of clocks is modulated by a spread spectrum method in order to reduce radiation noises.

SUMMARY

According to one aspect, this specification discloses an exposing device. The exposing device includes an exposing unit, a clock generator, and a driver. The exposing unit is configured to form a scanning line by exposing an image surface in a main scanning direction, and to form a plurality of pixels arrayed in the main scanning direction by sequentially forming a plurality of scanning lines shifted in a sub-scanning direction. The clock generator is configured to generate frequency-spread clocks having frequency that is spread with a particular modulation period and that changes in accordance with a modulated waveform corresponding to the particular modulation period. The driver is configured to drive the exposing unit to emit light during light emitting time that is determined from the frequency-spread clocks. The plurality of scanning lines is formed with respective phases of the modulated waveform. The phases corresponding to the plurality of scanning lines are shifted from each other for compensating, among the plurality of scanning lines, deviations of the light emitting time relative to a reference value, for each of the plurality of pixels.

According to another aspect, this specification also discloses an image forming apparatus. The image forming apparatus includes a photosensitive member, an exposing unit, a clock generator, and a driver. The photosensitive member is configured that an electrostatic latent image is formed thereon. The exposing unit is configured to form a scanning line by exposing the photosensitive member in a main scanning direction, and to form a plurality of pixels arrayed in the main scanning direction by sequentially forming a plurality of scanning lines shifted in a sub-scanning direction. The clock generator is configured to generate frequency-spread clocks having frequency that is spread with a particular modulation period and that changes in accordance with a modulated waveform corresponding to the particular modulation period. The driver is configured to drive the exposing unit to emit light during light emitting time that is determined from the frequency-spread clocks. The plurality of scanning lines is formed with respective phases of the modulated waveform. The phases corresponding to the plurality of scanning lines are shifted from each other for compensating, among the plurality of scanning lines, deviations of the light emitting time relative to a reference value, for each of the plurality of pixels.

According to still another aspect, this specification also discloses an exposing method. The exposing method includes: forming a scanning line by exposing an image surface in a main scanning direction, and forming a plurality of pixels arrayed in the main scanning direction by sequentially forming a plurality of scanning lines shifted in a sub-scanning direction; generating frequency-spread clocks having frequency that is spread with a particular modulation period and that changes in accordance with a modulated waveform corresponding to the particular modulation period; and driving an exposing unit to emit light during light emitting time that is determined from the frequency-spread clocks. The plurality of scanning lines is formed with respective phases of the modulated waveform. The phases corresponding to the plurality of scanning lines are shifted from each other for compensating, among the plurality of scanning lines, deviations of the light emitting time relative to a reference value, for each of the plurality of pixels.

BRIEF DESCRIPTION OF THE DRAWINGS

Aspects of this disclosure will be described in detail with reference to the following figures wherein.

DETAILED DESCRIPTION

Figure 1:
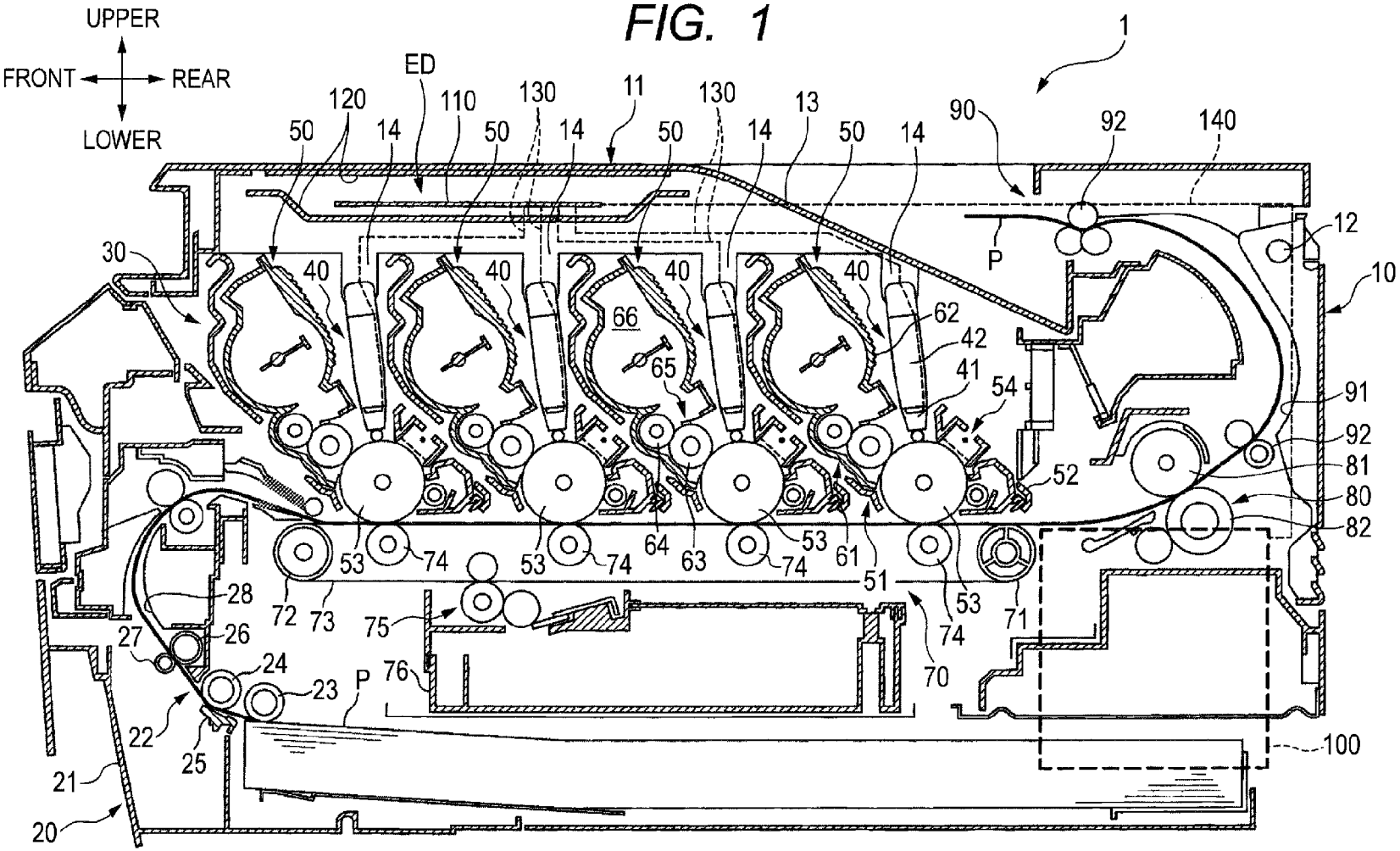
FIG. 1 is a cross-sectional view showing the overall configuration of a color printer according to an aspect of the disclosure.

Some aspects of the disclosure will be described while referring to the accompanying drawings.

In the following description, directions are defined as viewed from a user who uses a color printer which is described as an example of an image forming apparatus. That is, in FIG. 1, the left side in the drawing sheet is defined as "front side", the right side in the drawing sheet is defined as "rear side", the back side of the drawing sheet is defined as "left side", and the near side of the drawing sheet is defined as "right side". Further, the upper-lower direction in the drawing sheet is defined as "upper-lower direction".

As shown in FIG. 1, the color printer 1 includes, within a main casing 10, a paper feeding unit 20 that feeds paper P, an image forming unit 30 that forms an image on fed paper P, a paper discharging unit 90 that discharge paper P on which an image is formed, and a main board 100 that controls each unit when an image is formed.

An upper cover 11 is provided at an upper part of the main casing 10 for opening and closing an opening formed in the main casing 10. The upper cover 11 is pivotally movable upward and downward about a pivotal shaft 12 provided at the rear side. An upper surface of the upper cover 11 serves as a paper discharging tray 13 that accommodates paper P discharged from the main casing 10. A plurality of holding members 14 each holding an LED unit 40 is provided at a lower surface of the upper cover 11. An LED control board 110 and a shielding plate 120 facing the LED control board 110 are provided in the upper cover 11.

The paper feeding unit 20 mainly includes a paper feeding tray 21 and a paper feeding mechanism 22. The paper feeding tray 21 is provided at a lower part in the main casing 10, and is detachably mounted on the main casing 10. The paper feeding mechanism 22 conveys paper P from the paper feeding tray 21 to the image forming unit 30. The paper feeding mechanism 22 is provided at the front side of the paper feeding tray 21, and mainly includes a paper feeding roller 23, a separating roller 24, and a separating pad 25.

In the paper feeding unit 20 having this configuration, paper P in the paper feeding tray 21 is separated one sheet at a time and conveyed upward, and paper powders are removed in a process where the paper P passes between a paper-powder removing roller 26 and a pinch roller 27. After that, the paper P changes its direction toward the rear side while passing along a conveying path 28, and is fed to the image forming unit 30.

The image forming unit 30 mainly includes an exposing device ED, four process cartridges 50, a transfer unit 70, and a fixing unit 80. The exposing device ED includes the LED control board 110 and the four LED units 40.

Each LED unit 40 is provided above a photosensitive drum 53 (an example of a photosensitive member), and mainly includes an LED head 41 and a back plate 42. The LED head 41 is provided to face the photosensitive drum 53.

Figure 2A:
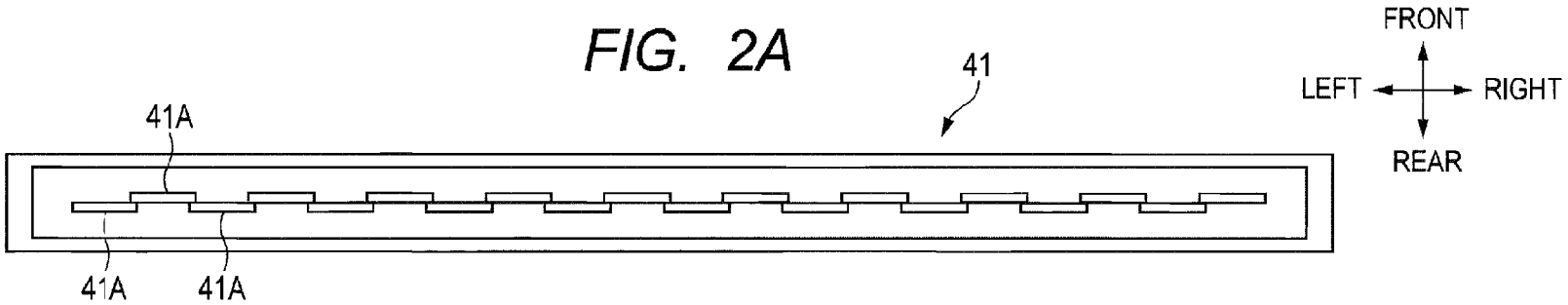
FIG. 2A shows an LED unit as viewed from the lower side.

As shown in FIG. 2A, the LED head 41 has twenty (20) SLED (Self-Scanning Light Emitting Device) chips 41A (an example of an exposing portion) in a surface facing the photosensitive drum 53. The SLED chips 41A are arranged in a staggered manner along a main scanning direction (left-right direction). Specifically, ten (10) pairs of SLED chips 41A are arranged along the left-right direction, each pair having a pair of SLED chips 41A adjacent to each other in the left-right direction and shifted in the front-rear direction.

Figure 2B:
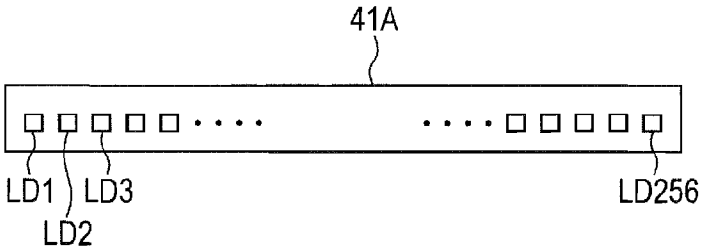
FIG. 2B is an enlarged view of an SLED chip.
Figure 2C:
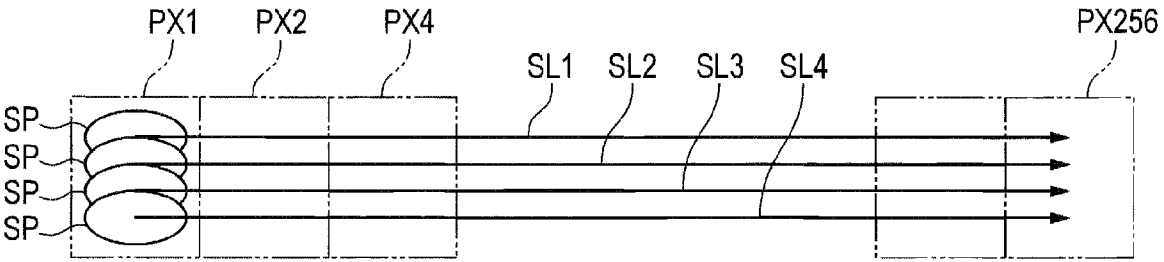
FIG. 2C is a diagram showing relationships among pixels, scanning lines and exposure spots.

As shown in FIG. 2B, the SLED chip 41A has 256 light emitting elements LD (LD1 to LD256) (an example of a light emitting portion). In each SLED chip 41A, the light emitting elements LD are controlled to blink (turn on and off) sequentially from the first light emitting element LD1 to the 256th light emitting element LD256, in a particular exposure time T3. With this operation, as shown in FIG. 2C, a surface (image surface) of the photosensitive drum 53 is scanningly exposed in the main scanning direction, so as to form one scanning line SL (for example, a scanning line SL1 as the first line).

In the present aspect, a plurality of pixels PX (PX1 to PX256) arranged in the main scanning direction is formed by four scanning lines SL1 to SL4 shifted in a sub-scanning direction. Specifically, exposure spots SP are formed on the photosensitive drum 53 by one light emitting element LD as an electrostatic latent image, and rotation of the photosensitive drum 53 causes the exposure spots SP to be sequentially superposed while being shifted in the sub-scanning direction, so that one pixel PX is formed.

And, each SLED chip 41A receives signals from the LED control board 110 based on data of an image to be formed, and controls each light emitting element LD1 to LD256 to turn on, thereby exposing the surface of the photosensitive drum 53 to light. The configuration and so on of the LED control board 110 will be described in detail.

Returning to FIG. 1, the back plate 42 is a member for supporting the LED head 41. The back plate 42 is pivotally attached to the upper cover 11 via the holding member 14. With this configuration, by pivotally moving the upper cover 11 upward, the LED unit 40 (the LED head 41) moves from an exposure position facing the photosensitive drum 53 to a retracted position located above the exposure position.

The process cartridges 50 are arranged in the front-rear direction between the upper cover 11 and the paper feeding unit 20. Each process cartridge 50 includes a drum unit 51 and a developing unit 61 that is detachably mounted on the drum unit 51. The process cartridge 50 is exchangeable through the opening of the main casing 10 in a state where the upper cover 11 is pivotally moved upward. In each process cartridge 50, only color of toner (developer) stored in a toner accommodating chamber 66 of the developing unit 61 is different, and the configuration of each process cartridge 50 is the same.

The drum unit 51 mainly includes a drum case 52, the photosensitive drum 53 rotatably supported by the drum case 52, and a charger 54.

The developing unit 61 includes a developing case 62, a developing roller 63 rotatably supported by the developing case 62, a supplying roller 64, and a blade assembly 65. The developing unit 61 has the toner accommodating chamber 66 that accommodates toner.

The transfer unit 70 is provided between the paper feeding unit 20 and each process cartridge 50. The transfer unit 70 mainly includes a drive roller 71, a follow roller 72, a conveying belt 73, transfer rollers 74, and a cleaning unit 75.

The drive roller 71 and the follow roller 72 are arranged in parallel and spaced away from each other in the front-rear direction. The conveying belt 73 constituted by an endless belt is looped between the drive roller 71 and the follow roller 72. An outer surface of the conveying belt 73 contacts each photosensitive drum 53. Inside the conveying belt 73, four transfer rollers 74 are arranged to face respective ones of the photosensitive drums 53 and to pinch the conveying belt 73 with the respective ones of the photosensitive drums 53. At the time of transfer, the transfer roller 74 is applied with a transfer bias by constant current control.

The cleaning unit 75 is disposed below the conveying belt 73. The cleaning unit 75 is configured to remove toner adhering to the conveying belt 73, and to cause removed toner to drop to a toner accommodating unit 76 that is disposed below the cleaning unit 75.

The fixing unit 80 is disposed at a rear side of the process cartridges 50 and the transfer unit 70. The fixing unit 80 includes a heat roller 81 and a pressure roller 82 that is disposed to face the heat roller 81 and to press the heat roller 81.

In the image forming unit 30 having the above-described configuration, first, the surface of each photosensitive drum 53 is uniformly charged by the charger 54, and then is exposed to LED light emitted from each LED head 41. With this operation, an electrostatic latent image based on image data is formed on each photosensitive drum 53.

Further, toner in the toner accommodating chamber 66 is supplied to the developing roller 63 due to rotation of the supplying roller 64, and enters between the developing roller 63 and the blade assembly 65 due to rotation of the developing roller 63, and is borne on the developing roller 63 as a thin layer of constant thickness.

When the developing roller 63 faces and contacts the photosensitive drum 53, toner borne on the developing roller 63 is supplied to the electrostatic latent image formed on the photosensitive drum 53. With this operation, toner is selectively borne on the photosensitive drum 53, the electrostatic latent image is visualized, and a toner image is formed by reversal development.

And, when paper P supplied onto the conveying belt 73 passes between each photosensitive drum 53 and the corresponding transfer roller 74 disposed inside the conveying belt 73, the toner image formed on each photosensitive drum 53 is sequentially transferred onto paper P. When paper P passes between the heat roller 81 and the pressure roller 82, the toner image transferred onto paper P is thermally fixed.

The paper discharging unit 90 mainly includes a paper-discharge-side conveying path 91 and a plurality of pairs of conveying rollers 92. The paper-discharge-side conveying path 91 is formed to extend upward from the exit of the fixing unit 80 and to turn its direction toward the front side. The plurality of pairs of conveying rollers 92 is configured to convey paper P. The paper P on which the toner image is transferred and thermally fixed is conveyed along the paper-discharge-side conveying path 91 by the conveying rollers 92, is discharged to outside of the main casing 10, and is accumulated in the paper discharging tray 13.

Next, the configuration and wiring structure around the LED control board 110 will be described in detail. First, the wiring structure will be described briefly.

Figure 3:
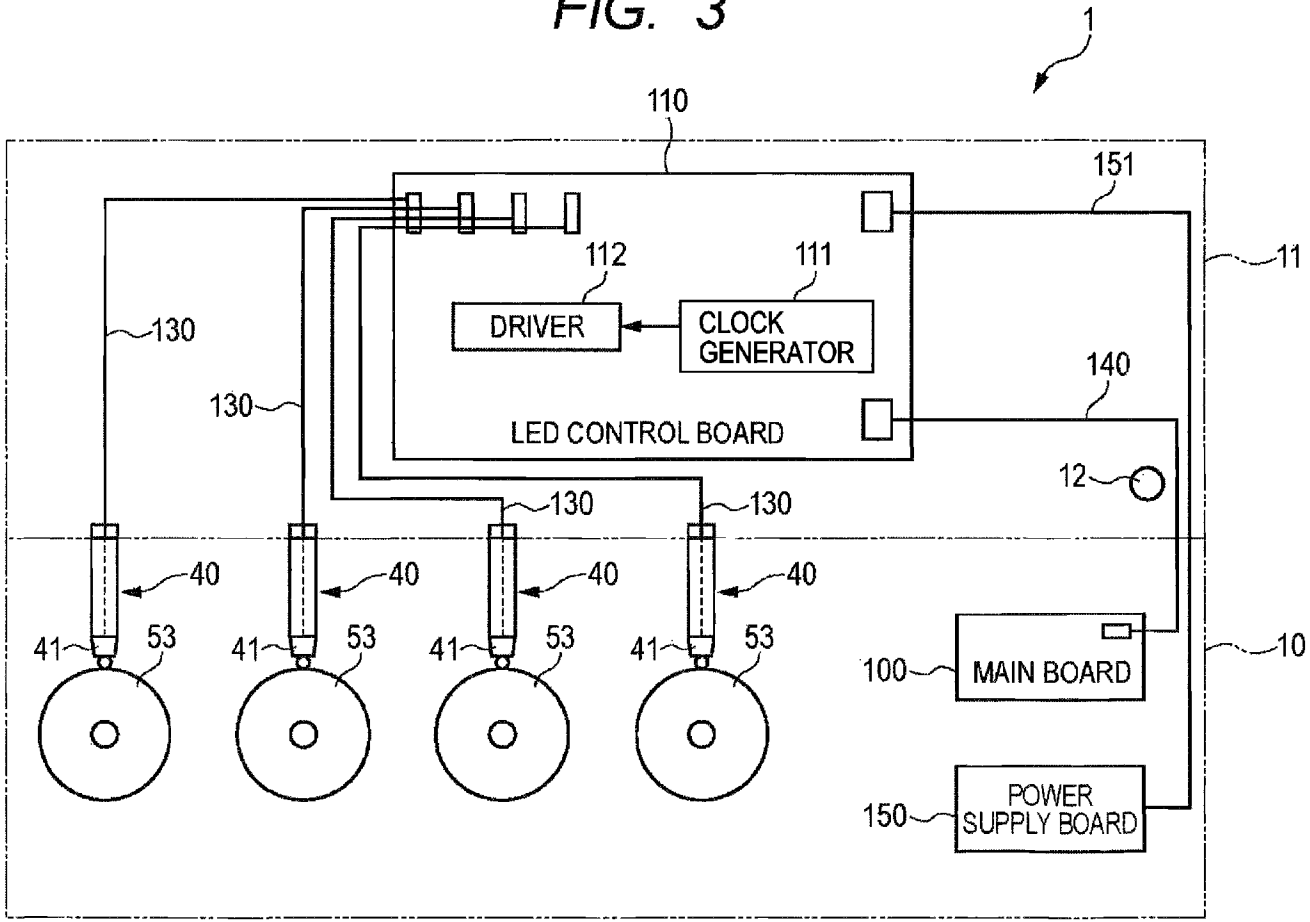
FIG. 3 is a diagram showing the configuration and wiring of an LED control board.

As shown in FIG. 3, the main board 100 controls each part of the color printer 1 at the time of image formation. Specifically, the main board 100 controls rotational speeds of the photosensitive drum 53 and the drive roller 71, conveying speed of paper P in the paper feeding unit 20 and the fixing unit 80, timing of light emission of each light emitting element LD, and so on. The main board 100 controls these values directly or indirectly via another control board (for example, the LED control board 110), and so on.

The LED control board 110 outputs signals to each SLED chip 41A of each LED head 41 based on data of an image to be formed, and controls light emission of each SLED chip 41A.

Each LED head 41 is electrically connected to the LED control board 110 by flat cables 130 having a plurality of signal lines. Further, the LED control board 110 is electrically connected to the main board 100 by a flat cable 140 having a plurality of signal lines.

In the present aspect, electric power of the LED control board 110 is supplied from a power supply board 150 that is provided within the main casing 10 separately from the main board 100. A cable 151 pulled out from the power supply board 150 is connected to the LED control board 110.

Next, the configuration of the LED control board 110 will be described in detail. The LED control board 110 includes a clock generator 111 and a driver 112.

Figure 4A:
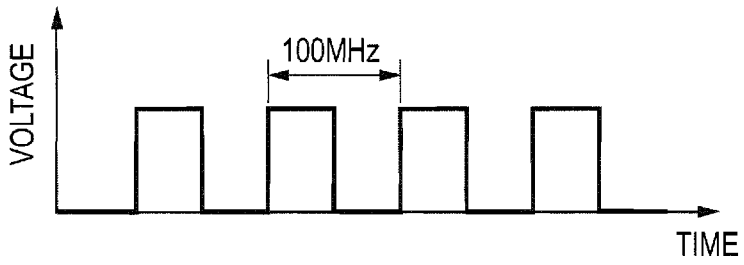
FIG. 4A is a diagram showing clocks oscillated with a reference frequency.
Figure 4B:
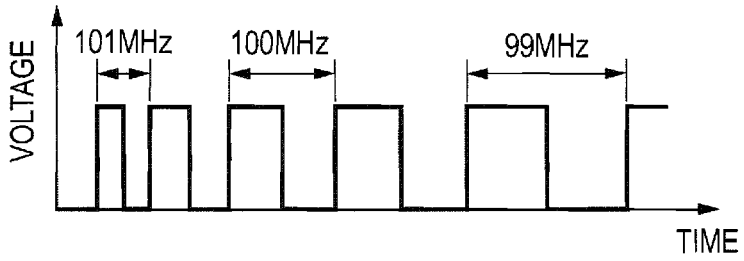
FIG. 4B is a diagram showing clocks with frequency spread.

The clock generator 111 is configured to spread (diffuse) frequency of clocks (pulse signals) of a constant period (for example, 100 MHz) shown in FIG. 4A with a particular modulation period T2, thereby generating frequency-spread clocks shown in FIG. 4B. Specifically, the clock generator 111 is constituted by an SSCG (Spread Spectrum Clock Generator). That is, the frequency of frequency-spread clocks changes by ±a few percent (for example, 1%) around a reference frequency fb (for example, 100 MHz).

Figure 5:
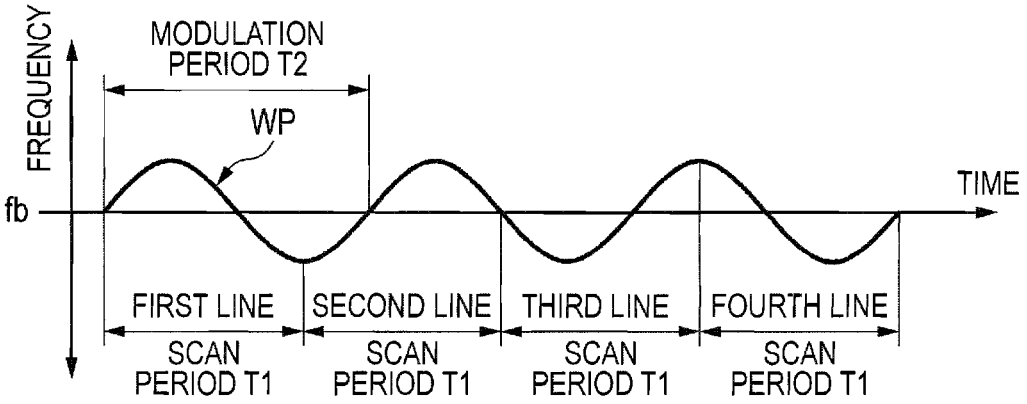
FIG. 5 is a diagram showing a relationship between a scan period and a modulation period.

Specifically, as shown in FIG. 5, the frequency of clocks changes in accordance with changes of a modulated waveform WP corresponding to the modulation period T2. Here, the vertical axis of the graph in FIG. 5 is the frequency of clocks. In the present aspect, the modulated waveform WP is such a waveform that the frequency changes with respect to time in a sine-curve shape.

The driver 112 is configured to drive each light emitting element LD1 to LD256 of each LED head 41 to emit light during time that is determined based on frequency-spread clocks. Specifically, the driver 112 drives one light emitting element LD to emit light during time corresponding to a particular number of clocks (for example, 60 clocks), thereby forming one exposure spot SP. Specifically, if the clock number allocated to one exposure spot SP is 80 clocks, for example, the driver 112 drives the light emitting element LD to emit light during time corresponding to 60 clocks out of 80 clocks, thereby forming one exposure spot SP.

And, in a case where one pixel PX is formed by using four exposure spots SP, the driver 112 drives the light emitting element LD to emit light during time corresponding to a clock number that is four times the above-described particular number of clocks (for example, 240 clocks) for one pixel PX.

In the present aspect, as shown in FIG. 5, in order to make exposure amounts of the plurality of pixels PX1 to PX256 approximately constant, the modulation period T2 and a scan period T1 are set such that a phase of the modulated waveform WP corresponding to the modulation period T2 is shifted from each other in the plurality of scanning lines SL1 to SL4 (the first to fourth line). Here, the scan period T1 is a period for scanning one scanning line SL, and is set to time that is longer than the exposure time T3 (T1>T3).

Here, the exposure time T3 is time in which scanning exposure is actually performed (that is, the time in which blinking control is actually performed from the first light emitting element LD1 to the 256th light emitting element LD256). Thus, a vacant time from a time point when blinking control for the 256th light emitting element LD256 is finished to a time point when blinking control for the first light emitting element LD1 is started is time (T1-T3) in which no blinking control is performed at all for the light emitting elements LD1 to LD256.

Next, the relationship between the modulation period T2 and the scan period T1 will be described in detail.

In the LED control board 110, assuming that N is the number of scanning lines forming the plurality of pixels PX, that L is a divisor of N/2, and K is an integral number greater than or equal to one, the modulation period T2 and the scan period T1 are set so as to satisfy the following equation (1).

$$T1/T2=K\pm\{1/(2\times L)\} \quad (1)$$

In the present aspect, it is assumed that the number N of scanning lines forming the plurality of pixels PX is 4, and that the divisor of N/2 is 2. As a condition satisfying the above equation (1) when K=1, the scan period T1 is set to ¾ times the modulation period T2. By setting the scan period T1 and the modulation period T2 in this way, the phases of the modulated waveforms WP are shifted by π/2 (pi/2) in adjacent scanning lines SL.

That is, the modulation period T2 and the scan period T1 are set such that the phase of the modulated waveform WP of the second line is shifted by π/2 relative to the phase of the modulated waveform WP of the first line, that the phase of the modulated waveform WP of the third line is shifted by π/2 relative to the phase of the modulated waveform WP of the second line, and that the phase of the modulated waveform WP of the fourth line is shifted by π/2 relative to the phase of the modulated waveform WP of the third line.

Figure 6:
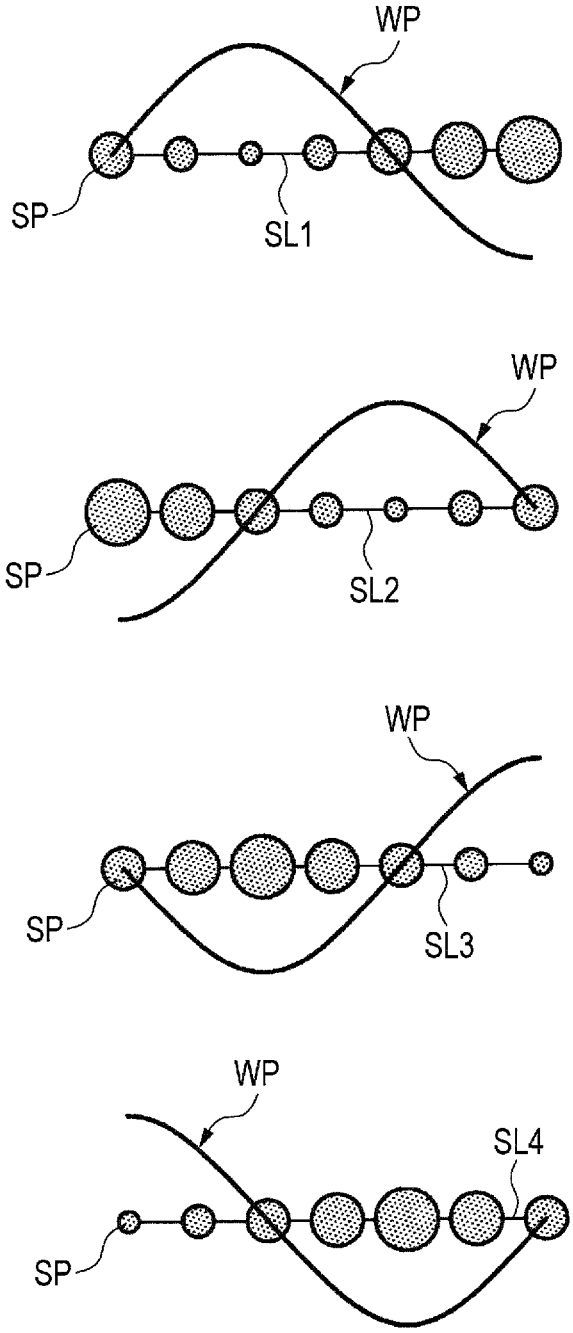
FIG. 6 shows diagrams of modulated waveforms and exposure spots in each scanning line.

Next, operational effects of the present aspect will be described in detail while referring to FIG. 6. In FIG. 6, for simplification, the magnitude of an exposure amount of each exposure spot SP is represented by the size of the spot. Also, the number of the exposure spots SP shown in FIG. 6 is smaller than the actual number of the spots (256).

As shown in FIG. 6, because the scan period T1 is ¾ times the modulation period T2, the phase of the modulated waveform WP of the third line is shifted, by exactly π(pi), from the phase of the modulated waveform WP of the first line, and the two waves interfere with and compensate (cancel in the example of FIG. 6) each other. Similarly, the phase of the modulated waveform WP of the fourth line is shifted, by exactly π(pi), from the phase of the modulated waveform WP of the second line, and the two waves interfere with and compensate each other. In other words, in four scanning lines forming one pixel PX, the phase of the modulated waveform WP is in a balanced state.

Hence, a total exposure amount of four exposure spots SP overlapping in the sub-scanning direction for forming one pixel PX is substantially constant among the plurality of pixels PX, to such an extent that a user cannot recognize density deviation of an image. Specifically, the exposure amount of the exposure spots SP is the smallest at a portion where frequency of clocks (a value of the modulated waveform WP in the vertical axis) is the highest. Conversely, the exposure amount of the exposure spots SP is the largest at a portion where the frequency of clocks is the lowest. Thus, as described above, the modulated waveforms WP are compensated in the scanning lines SL1 to SL4, so that the exposure amount in the plurality of pixels PX arranged in the main scanning direction (the total exposure amount of four exposure spots SP) is substantially constant.

In other words, light emitting time of each light emitting element LD is the shortest at a portion where frequency of clocks is the highest, and the light emitting time of each light emitting element LD is the longest at a portion where frequency of clocks is the lowest. Thus, as described above, the modulated waveforms WP are compensated in the scanning lines SL1 to SL4, and differences between light emitting time of the light emitting element LD for one pixel PX and a reference value are compensated in the plurality of scanning lines, so that total light emitting time for the four times becomes substantially constant among the plurality of pixels PX. Here, the reference value of light emitting time is time corresponding to the reference frequency fb.

As described above, compared with a conventional cumbersome control that exposure time is changed for each pixel based on a modulated waveform, in the present aspect, the exposure amount among the plurality of pixels PX becomes substantially constant by a simple method that the phases of the modulated waveforms WP are shifted in the plurality of scanning lines SL1 to SL4.

The modulated waveform WP is a waveform that frequency changes with respect to time in a sine-wave shape. Thus, for example, compared with a case in which the modulated waveform is a waveform that frequency changes with respect to time in a trapezoidal waveform, by shifting the phases of the modulated waveforms WP in the scanning lines SL1 to SL4 by a certain amount (π/2), the light emitting time of each pixel PX becomes substantially constant.

The scan period T1 and the modulation period T2 have the relationship satisfying the above equation (1). Thus, after the first scanning line SL1 is scanned and when the second and subsequent scanning lines SL2-SL4, SL1, . . . are scanned, a special control need not to be performed, and the exposure amount among the plurality of pixels PX becomes substantially constant. That is, for example, compared with a case in which the phases of the modulated waveforms WP are shifted regardless of the relationship between the scan period T1 and the modulation period T2 as in an aspect described later, it is unnecessary to wait for delay time after the first scanning line SL1 is scanned, and formation of the subsequent scanning line SL2 can be started directly.

The scan period T1 is set to time that is longer than the exposure time T3. Thus, a partial time (T1-T3) of the scan period T1 is always time in which no scanning exposure is performed, and the light emitting element LD can be cooled during that time.

While the disclosure has been described in detail with reference to the above aspects thereof, it would be apparent to those skilled in the art that various changes and modifications may be made therein without departing from the scope of the claims. In the following description, like parts and components are designated by the same reference numerals to avoid duplicating description.

In the above-described aspect, the phases of the modulated waveforms WP are shifted by π/2. The disclosure is not limited to this. In an example where the four scanning lines SL1 to SL4 form the plurality of pixels PX1 to PX256 arranged in the main scanning direction (one pixel array), the phases of the modulated waveforms WP may be shifted by π. With this example, effects similar to those in the above-described aspect can be obtained. Specifically, in this case as well, the modulated waveforms WP are compensated between the first line and the second line, and the modulated waveforms WP are compensated between the third line and the fourth line.

However, in the above-described aspect, the phases of the modulated waveforms WP are shifted by π/2 that is the smallest phase in an example where the plurality of pixels PX is formed by four lines, which suppresses abrupt change in difference of the exposure amount of each exposure spot in one pixel PX. That is, for example, if the phases are shifted by it in a case where the number of scanning lines is four, a spot having the largest exposure amount and a spot having the smallest exposure amount are adjacent to and overlap each other in one pixel, and the difference of the exposure amount may change abruptly. On the other hand, as in the above-described aspect, if the phases are shifted by π/2 in a case where the number of scanning lines is four, a spot having the largest exposure amount and a spot having the smallest exposure amount are not adjacent to and does not overlap each other in one pixel (see FIG. 6), and abrupt change in the difference of the exposure amount can be suppressed.

In the above-described aspect, the four scanning lines SL1 to SL4 form the plurality of pixels PX1 to PX256 arranged in the main scanning direction (one pixel array). The disclosure is not limited to this. As long as one pixel array is formed by even number of scanning lines, the disclosure can be applied to an arbitrary aspect. A configuration may be such that one or a plurality of pairs of scanning lines for which modulated waveforms are compensated exists in a range of one pixel array in the sub-scanning direction, and that the modulated waveform at the time of starting scanning of the first line of the first pixel array has the same phase as the modulated waveform at the time of starting scanning of the first line of the second pixel array.

In this case, regarding the relationship between the number of scanning lines and a shift (deviation) of the phase of modulated waveforms, for example, assuming that N is the number of scanning lines forming one pixel array, the phases of modulated waveforms are shifted by $2\pi/N$ in adjacent scanning lines. In this example, the phases are shifted by $2\pi/N$ which is the smallest phase in an example where a plurality of pixels is formed by N lines, which suppresses abrupt change in difference of the exposure amount of each exposure spot in one pixel.

In the above-described aspect, as an example of control of the light emitting element LD by the driver 112, in a case where the number of clocks allocated to one exposure spot SP is 80 clocks, light is emitted only during time corresponding to 60 clocks out of 80 clocks. The disclosure is not limited to this. For example, by considering variations of luminous efficiency of each light emitting element, correction may be performed by using predetermined light emitting time (the number of clocks) so as to correct the variations of luminous efficiency. Specifically, in a case where the number of clocks allocated to one exposure spot SP is 80 clocks, light may be emitted only during time corresponding to (60±A) clocks out of 80 clocks. Here, ±A clocks are an exposure-amount correction value that is set preliminary for each light emitting element based on luminous efficiency of each light emitting element.

Figure 7:
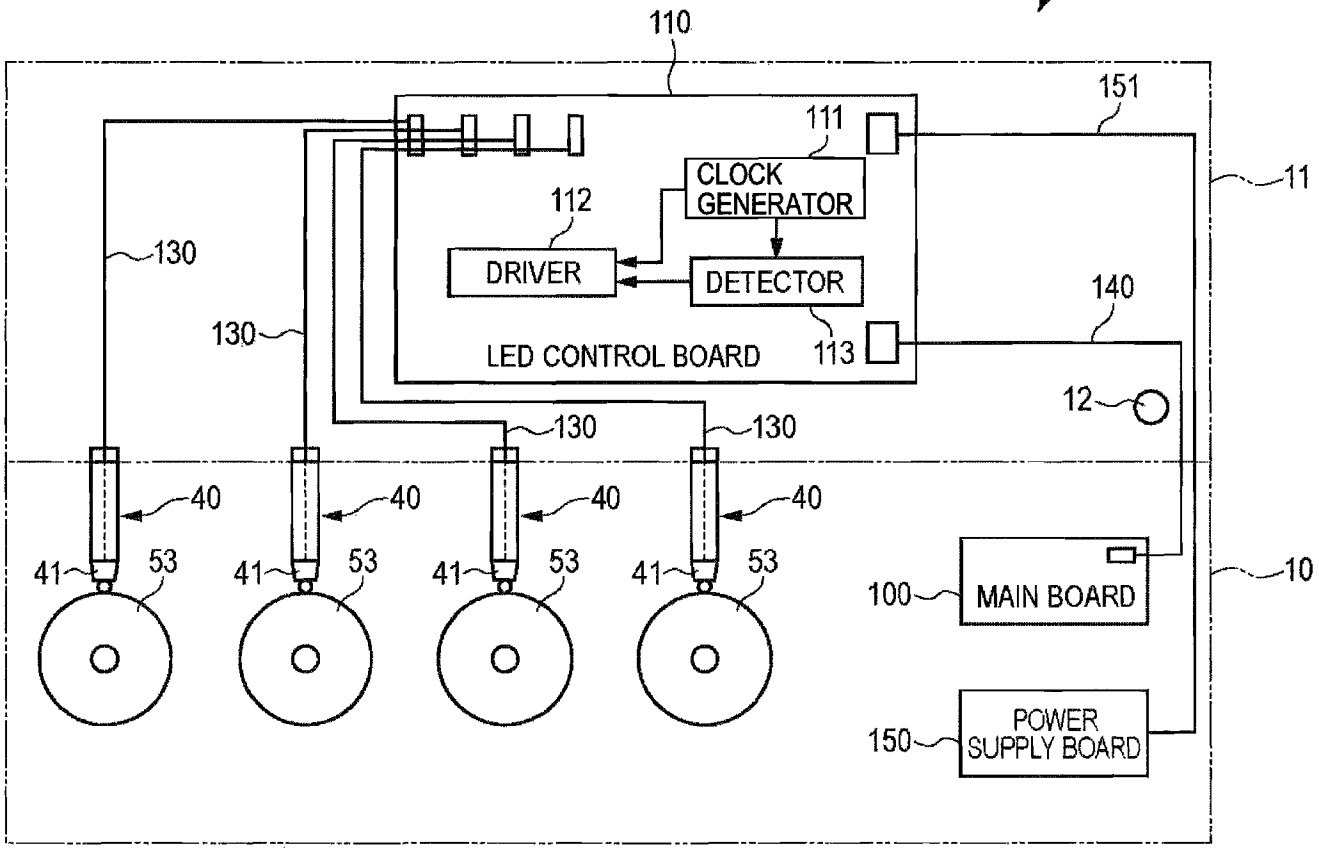
FIG. 7 is a diagram showing an LED control board according to a first modification.

In the above-described aspect, the scan period T1 and the modulation period T2 are set to appropriate values in order to shift the phases of the modulated waveforms WP in the scanning lines SL1 to SL4. However, the disclosure is not limited to this. For example, as shown in FIG. 7, the LED control board 110 may include a detector 113 that detects clocks generated from the clock generator 111, and the driver 112 may be configured to start forming each scanning line SL based on a detection result of the detector 113, thereby shifting the phases of the modulated waveforms WP in each scanning line SL.

Figure 8:
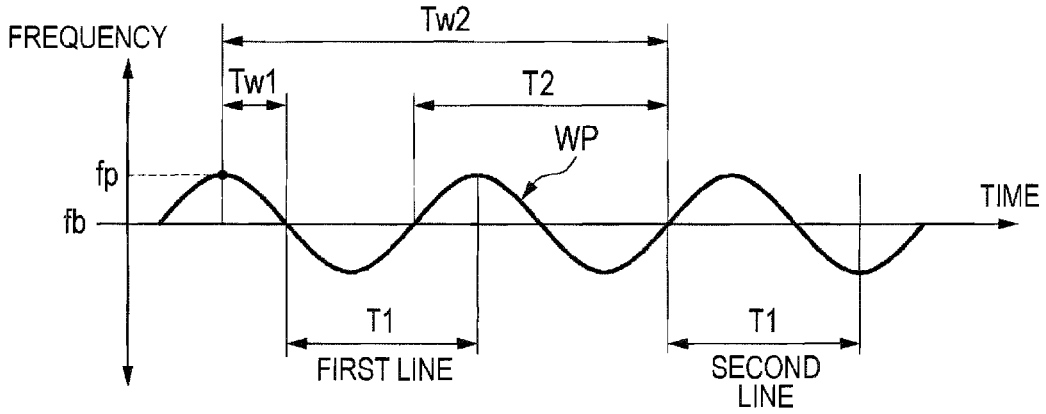
FIG. 8 is a diagram showing delay time according to the first modification.

Specifically, as shown in FIG. 8, the detector 113 determines whether frequency of clocks reaches a positive (plus) peak value fp (particular value). When the frequency reaches the peak value fp, the detector 113 outputs, to the driver 112, a peak signal indicating that the frequency is the peak value fp. The driver 112 is configured to wait for a first delay time Tw1 or a second delay time Tw2 corresponding to each scanning line SL after receiving the peak signal, and then start forming the scanning line SL.

Here, in this example, it is assumed that the number of scanning lines SL for forming a plurality of pixels PX1 to PX256 (one pixel array) is two.

The first delay time Tw1 for determining timing of starting forming the first scanning line SL1 is set to ¼ times the modulation period T2. Thus, the modulated waveform WP corresponding to the first line is a waveform that an initial frequency is the reference frequency fb and that the frequency starts changing from the reference frequency fb in the minus direction.

Figure 9:
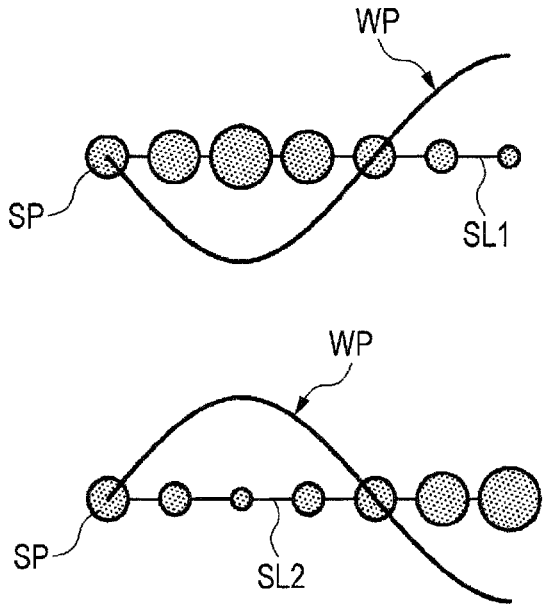
FIG. 9 shows diagrams showing modulated waveforms and exposure spots in each scanning line according to the first modification.

The second delay time Tw2 for determining timing of starting forming the second scanning line SL2 is set to 7/4 times the modulation period T2. Thus, the modulated waveform WP corresponding to the second line is a waveform that an initial frequency is the reference frequency fb and that the frequency starts changing from the reference frequency fb in the plus direction. That is, the phase of the modulated waveform WP of the second line is shifted by π (pi) relative to the modulated waveform WP of the first line. With this configuration, as shown in FIG. 9, the modulated waveform WP of the first line and the modulated waveform WP of the second line interfere with and compensate each other. Hence, the total exposure amount (total light emitting time) of two exposure spots SP overlapping in the sub-scanning direction for forming one pixel PX becomes substantially constant among the plurality of pixels PX.

Figure 10:
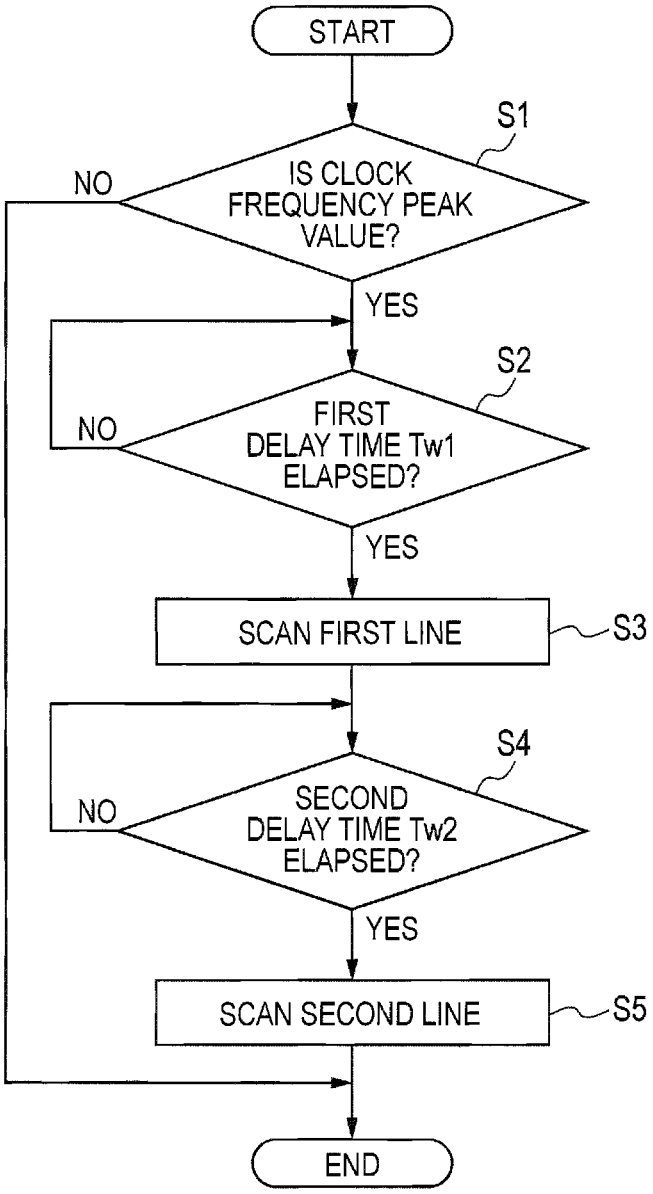
FIG. 10 is a flowchart showing operations of a driver.

Specifically, the driver 112 performs control in accordance with the flowchart shown in FIG. 10. As shown in FIG. 10, first, the driver 112 determines whether frequency of clocks reaches a peak value, by determining whether a peak signal is received from the detector 113 (S1).

In S1, if it is determined that the frequency of clocks is not the peak value (S1: No), the driver 112 finishes this process. In S1, if it is determined that the frequency of clocks is the peak value (S1: Yes), the driver 112 determines whether a first delay time Tw1 has elapsed from a time point at which the peak signal is received (S2). Here, for example, determination of whether the first delay time Tw1 has elapsed may be performed by counting a timer from a time point at which the peak signal is received.

If it is determined in S2 that the first delay time Tw1 has elapsed (S2: Yes), the driver 112 scans the first line (S3). After S3, the driver 112 determines whether a second delay time Tw2 has elapsed from the time point at which the peak signal is received (S4). Here, for example, determination of whether the second delay time Tw2 has elapsed may be performed by counting a timer from the time point at which the peak signal is received, as described above.

If it is determined in S4 that the second delay time Tw2 has elapsed (S4: Yes), the driver 112 scans the second line (S5). With this process, as shown in FIG. 9, the phase of the modulated waveform WP of the second line is shifted by π (pi) from the phase of the modulated waveform WP of the first line. Hence, the total exposure amount (total light emitting time) of two exposure spots SP overlapping in the sub-scanning direction for forming one pixel PX is substantially constant among the plurality of pixels PX.

According to this example, timing of starting forming each scanning line SL is determined based on the detection result of the detector 113. Thus, the exposure amount among the plurality of pixels PX is substantially constant, regardless of the relationship between the scan period T1 and the modulation period T2. In this example, a positive (plus) peak value is shown as an example of the particular value. The disclosure is not limited to this, and the particular value may be a negative (minus) peak value, for example.

In the above-described aspect, the SLED chip 41A is shown as an example of an exposing unit. The disclosure is not limited to this. For example, the exposing unit may be a semiconductor laser provided in an exposing device that scans laser light by a polygon mirror, and so on.

In the above-described aspect, the photosensitive drum 53 is shown as an example of a photosensitive member. The disclosure is not limited to this. The photosensitive member may be a belt-shaped photosensitive member, for example.

In the above-described aspect, the disclosure is applied to the color printer 1. The disclosure is not limited to this, and may be applied to other image forming apparatuses, such as a monochromatic printer, a copier, and a multifunction peripheral (MFP).

The following is description about calculation conditions in the above-described aspect. Specifically, the following is calculation results of variations of light amount per pixel when a ratio T1/T2 of the scan period T1 to the modulation period T2 is changed.

The calculation conditions are as follows.

1. Resolution in the main scanning direction: 600 dpi (dots per inch)

2. Resolution in the sub-scanning direction: 2400 dpi

3. Amplitude of modulated waveform: 2% of the reference frequency of clocks

4. Ratio of periods T1/T2: 1.0 to 3.0

5. The number of scanning lines for forming one pixel array: 4

Calculation was performed with the above conditions, and variations of light amount in a ratio T1/T2 of each period (difference between the maximum value and the minimum value of sums of exposure amounts of four exposure spots SP forming each pixel PX) were calculated. As a result, the graph shown in FIG. 11 was obtained. Here, the horizontal axis in FIG. 11 indicates a ratio of periods T1/T2, and the vertical axis indicates a shift amount (deviation amount) of an exposure amount relative to the reference value.

Figure 11:
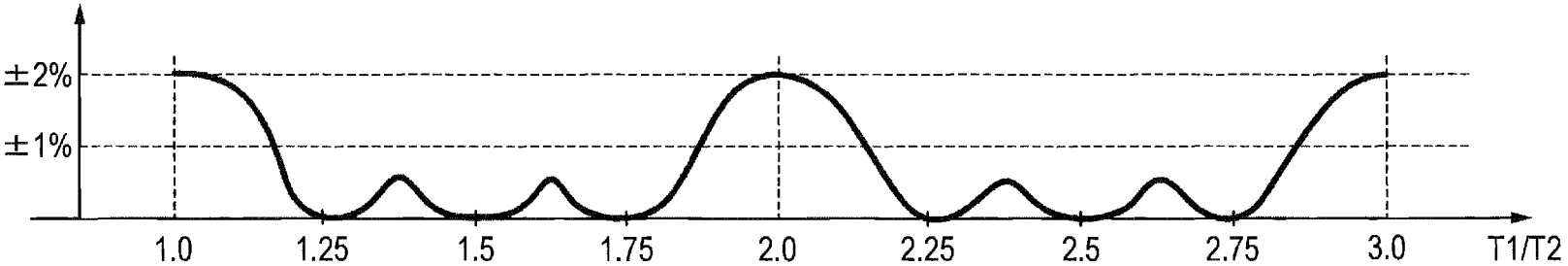
FIG. 11 is a diagram showing calculation results about relationships between ratios of periods T1/T2 and variations of light intensity.

According to the graph in FIG. 11, it can be seen that the variation of a light amount is the largest at portions where the ratio of periods T1/T2 is integral numbers 1.0, 2.0, and 3.0. Also, it can be seen that the variation of a light amount is small around portions where the ratio of periods T1/T2 is 1.25, 1.5, 1.75, 2.25, 2.5, and 2.75.

Based on these facts, the variation of a light amount can be made small by satisfying the following condition. Assuming that N is the number of scanning lines, that L is a divisor of N/2, and that K is an integral number greater than or equal to one, the following equation (1) is satisfied as in the above-described aspect.

$$T1/T2=K\pm\{1/(2\times L)\} \quad (1)$$

Specifically, when N=4, the divisors L of N/2 are 1 and 2. Thus, the equation (1) becomes the following two equations (2) and (3).

$$T1/T2=K\pm(1/2) \quad (2)$$

$$T1/T2=K\pm(1/4) \quad (3)$$

When 2 is assigned to K in the equation (2), 1.5 and 2.5 are obtained as values of T1/T2. When 1, 2, or 3 is assigned to K in the equation (3), 1.25, 1.75, 2.25, and 2.75 are obtained as values of T1/T2. Accordingly, by determining the scan period T1 and the modulation period T2 so as to satisfy the equation (1), values similar to the above-mentioned calculation results are obtained.

What is claimed is:

1. An exposing device comprising:

an exposing unit configured to form a scanning line by exposing an image surface in a main scanning direction, and to form a plurality of pixels arrayed in the main scanning direction by sequentially forming a plurality of scanning lines shifted in a sub-scanning direction;

a clock generator configured to generate frequency-spread clocks having frequency that is spread with a particular modulation period and that changes in accordance with a modulated waveform corresponding to the particular modulation period; and a driver configured to drive the exposing unit to emit light during light emitting time that is determined from the frequency-spread clocks, wherein the plurality of scanning lines is formed with respective phases of the modulated waveform; and wherein the phases corresponding to the plurality of scanning lines are shifted from each other for compensating, among the plurality of scanning lines, deviations of the light emitting time relative to a reference value, for each of the plurality of pixels, wherein a following equation is satisfied: T1/T2=K±{1/(2×L)}, when T1 is a period for scanning one scanning line, T2 is the modulation period, N is a number of scanning lines forming the plurality of pixels, L is a divisor of N/2, and K is an integral number greater than or equal to one.

2. The exposing device according to claim 1, wherein the modulated waveform has such a shape that frequency changes in a sine wave form with respect to time.

3. The exposing device according to claim 1, wherein the driver is configured to drive the exposing unit to emit light during time corresponding to a particular number of clocks, so as to form one pixel.

4. The exposing device according to claim 1, wherein phases of the modulated waveform in adjacent scanning lines are shifted by 2π/N, when N is a number of scanning lines forming the plurality of pixels.

5. The exposing device according to claim 1, wherein an inequality T1>T3 is satisfied when T3 is time during which scanning exposure is performed out of the period T1.

6. The exposing device according to claim 1, further comprising a detector configured to detect the clocks, wherein the driver is configured to start forming each of the particular number of scanning lines based on a detection result of the detector.

7. The exposing device according to claim 6, wherein the detector is configured to output a signal when frequency of the clocks becomes a particular value; and wherein the driver is configured to wait for delay time corresponding to each of the particular number of scanning lines after the signal is received, and to start forming the each of the particular number of scanning lines.

8. An image forming apparatus comprising:

a photosensitive member configured that an electrostatic latent image is formed thereon;

an exposing unit configured to form a scanning line by exposing the photosensitive member in a main scanning direction, and to form a plurality of pixels arrayed in the main scanning direction by sequentially forming a plurality of scanning lines shifted in a sub-scanning direction;

a clock generator configured to generate frequency-spread clocks having frequency that is spread with a particular modulation period and that changes in accordance with a modulated waveform corresponding to the particular modulation period; and a driver configured to drive the exposing unit to emit light during light emitting time that is determined from the frequency-spread clocks, wherein the plurality of scanning lines is formed with respective phases of the modulated waveform; and wherein the phases corresponding to the plurality of scanning lines are shifted from each other for compensating, among the plurality of scanning lines, deviations of the light emitting time relative to a reference value, for each of the plurality of pixels, wherein a following equation is satisfied: T1/T2=K±{1/(2×L)}, when T1 is a period for scanning one scanning line, T2 is the modulation period, N is a number of scanning lines forming the plurality of pixels, L is a divisor of N/2, and K is an integral number greater than or equal to one.

9. The image forming apparatus according to claim 8, wherein the modulated waveform has such a shape that frequency changes in a sine wave form with respect to time.

10. The image forming apparatus according to claim 8, wherein the driver is configured to drive the exposing unit to emit light during time corresponding to a particular number of clocks, so as to form one pixel.

11. The image forming apparatus according to claim 8, wherein phases of the modulated waveform in adjacent scanning lines are shifted by $2\pi/N$, when N is a number of scanning lines forming the plurality of pixels.

12. The image forming apparatus according to claim 8, wherein an inequality $T1>T3$ is satisfied when $T3$ is time during which scanning exposure is performed out of the period $T1$.

13. The image forming apparatus according to claim 8, further comprising a detector configured to detect the clocks, wherein the driver is configured to start forming each of the particular number of scanning lines based on a detection result of the detector.

14. The image forming apparatus according to claim 13, wherein the detector is configured to output a signal when frequency of the clocks becomes a particular value; and wherein the driver is configured to wait for delay time corresponding to each of the particular number of scanning lines after the signal is received, and to start forming the each of the particular number of scanning lines.

* * * * *